US007281773B2

(12) United States Patent
Sato et al.

(10) Patent No.: US 7,281,773 B2
(45) **Date of Patent: *Oct. 16, 2007**

(54) SLIDING ASSISTING APPARATUS

(75) Inventors: Hiroji Sato, Tokyo (JP); Yasutomo Kobayashi, Yamato (JP)

(73) Assignee: Nifco Inc., Yokohama-Shi (JP)

( * ) Notice: Subject to any disclaimer, the term of this patent is extended or adjusted under 35 U.S.C. 154(b) by 211 days.

This patent is subject to a terminal disclaimer.

(21) Appl. No.: 11/175,361

(22) Filed: Jul. 7, 2005

(65) Prior Publication Data

US 2006/0017358 A1 Jan. 26, 2006

(30) Foreign Application Priority Data

Jul. 21, 2004 (JP) ..... 2004-213626

(51) Int. Cl.
*A47B 88/00* (2006.01)

(52) U.S. Cl. ..... 312/333

(58) Field of Classification Search ..... 312/333, 312/334.46, 334.27, 319.1, 334.1, 334.7, 312/334.44; 384/21, 19
See application file for complete search history.

(56) References Cited

U.S. PATENT DOCUMENTS

| | | | | |
|---|---|---|---|---|
| 345,227 | A * | 7/1886 | Fraser | 312/334.32 |
| 6,039,421 | A * | 3/2000 | Fulterer | 312/333 |
| 6,398,327 | B1 * | 6/2002 | Momoze | 312/319.1 |
| 6,848,759 | B2 * | 2/2005 | Doornbos et al. | 312/319.1 |
| 7,028,370 | B2 * | 4/2006 | Hoshide et al. | 16/96 R |
| 7,185,959 | B2 * | 3/2007 | Mueller et al. | 312/331 |
| 2002/0096405 | A1 | 7/2002 | Gasser | |
| 2003/0067257 | A1 | 4/2003 | Gasser | |
| 2004/0104649 | A1 * | 6/2004 | Muller et al. | 312/333 |
| 2005/0218759 | A1 * | 10/2005 | Kobayashi et al. | 312/331 |
| 2006/0017359 | A1 * | 1/2006 | Sato et al. | 312/333 |

FOREIGN PATENT DOCUMENTS

| | | |
|---|---|---|
| EP | 1 188 397 A1 | 3/2002 |
| EP | 1 350 443 A 1 | 10/2003 |
| GB | 1 500 767 A | 2/1978 |
| JP | 02-286102 | 11/1990 |

* cited by examiner

*Primary Examiner*—Janet M. Wilkens
(74) *Attorney, Agent, or Firm*—Manabu Kanesaka

(57) ABSTRACT

A sliding assisting apparatus assists a movable body to move between a drawn-out position and a drawn-in position. The apparatus includes a unit main body to be attached to a main body or the movable body, and a pair of strikers to be attached to the main body or movable body. The unit main body includes a pair of sliders slidably disposed inside a case, lock members movably supported on the respective sliders, coupling parts provided on the case for engaging the lock members, and an urging device provided between the sliders for accumulating a force when the sliders slide away from the other. One striker switches one slider between a case restrained position in which one coupling part engages one lock member and a case restraint released position in which the one coupling part releases the one lock member.

8 Claims, 12 Drawing Sheets

2 (20)
3 (31)
4 (41)
5
6
6a
6b
10
13
13a
13b
15
18
18a
18b
22
23
24
25
27
30
32
37
38
40
43
48

SLIDING ASSISTING APPARATUS

BACKGROUND OF THE INVENTION AND RELATED ART STATEMENT

The present invention relates to a sliding assisting apparatus for assisting an operation of a movable body such as a drawer or cover body to slide on a main body and switch between a drawn-in position and a drawn-out position.

In a structure in which a movable body is switched to slide between a drawn-in position and a drawn-out position on a main body, as disclosed in Patent Document 1, it is tiresome and lacks a feeling of high quality as all of the switching operations are performed by a hand. Accordingly, it is dealt with in a manner such that the movable body is forced in either direction of the drawn-out position or the drawn-in position and is slid automatically toward the forced direction.

FIGS. 14(*a*) and 14(*b*) show a drawer apparatus disclosed in Patent Document 1; wherein FIG. 14(*a*) is a state drawing of the drawn-in position of the movable body not illustrated, and FIG. 14(*b*) is the drawn-out position. Symbol 50 is a side wall of a main body, symbol 55 is a drive pin on a side of the movable body, symbol 60 is a tilting part placed between a main body side wall and the movable body, and symbol 65 is a spring member. A guide track 51 is provided on the main body side wall 50. The guide track 51 is constituted by a straight part 51*a* which extends horizontally in the front-to-back direction, and a bow-shaped part 51*b* on the front side (right side in the drawing).

The tilting part 60 has a slot 61 which is opened at the top, and a diagonal side wall 62 which extends from the front side of the slot 61. Bolts 63 are coupled in the guide track 51. The spring member 65 accumulates force in the course of sliding of the movable body from the drawn-in position to the drawn-out position, in a state in which one end is fixed on the side of the main body and the other end is fixed on the tilting part 60. Also, in this structure, the movable body is built into the side of the main body in a state in which the drive pin 55 is coupled in the slot 61.

When the movable body is slid from the drawn-in position to the drawn-out position, the tilting part 60 is moved following the straight part 51*a* of the guide track 51, and then it is tilted forward at the bow-shaped part 51*b*, and the drive pin 55 moves from the slot 61 to the diagonal side wall 62. By this, the movable body is checked or locked in the drawn-out position in opposition to the force of the spring member 65, and also by being pushed backward it is drawn in by the force accumulated in the spring member 65 after the drive pin 55 is returned from the diagonal wall part 62 to the slot 61.

Patent Document 1: Japanese Publication Patent (Kokoku) No. 05-023763

In the above-mentioned conventional structure, for example, although the movable body is slid automatically almost entirely from the drawn-out position to the drawn-in position, a strong pulling operation force by that amount becomes necessary when going from the drawn-in position to the drawn-out position, and the convenience of use becomes poor. Also, because the drive pin 55 is made to escape from the slot 61 by the forward tilting of the tilting member 60 and is coupled with the diagonal side wall 62 as a lock mechanism for locking the movable body in opposition to the force of the spring member 65, the coupling force is poor and there is a fear that the lock may be released by vibrations, and the like.

Moreover, in the conventional structure, once the movable body is removed from the main body, because it is drawn into the main body by the force of the spring member 65 in a state having the slot 61 turned upwardly as shown in FIG. 14(*a*) by releasing of the tilting part 60 from the drive pin 55, it is difficult to assemble the movable body again on the main body, and the drive pin 55, and the like, are easily damaged when the movable body is forcefully pushed in toward the side of the main body. Also, in the conventional structure, the operational characteristics are limited in that it does not have functions for assisting both operations in the case of sliding the movable body in the direction of the drawn-in position and when sliding it in the direction of the drawn-out position.

An object of the present invention is to eliminate problems as stated above, for example, and to improve the convenience of use and feeling of high quality of the apparatus to which it is applied by a comparatively simple structure.

Further objects and advantages of the invention will be apparent from the following description of the invention.

SUMMARY OF THE INVENTION

In order to achieve the objects described above, according to the present invention, a sliding assisting apparatus assists an operation of drawing in a movable body from a drawn-out position to a drawn-in position and an operation of drawing out the same from the drawn-in position to the drawn-out position relative to a main body. The sliding assisting apparatus comprises: a pair of sliders provided on one of the main body and the movable body and disposed inside a case for sliding in a direction that the movable body moves; a lock member rotatably supported on each of the sliders and having a front end protruding out of the case; a coupling part provided on the case for engaging the lock members of the sliders; a drawing-out/drawing-in unit main body having a urging device provided between the sliders for accumulating a force when one of the sliders slides away from the other; and a pair of strikers provided on the other of the main body and the movable body for switching the sliders between a case restrained position in which the coupling part engages the lock members to fix the sliders to the case, and a case restraint released position in which the coupling part releases the lock members so that the sliders slide relative to the case.

In the apparatus of the present invention above, in particular, it is made such that when the movable body is drawn out from the drawn-in position to a mid-course position, and when the movable body is drawn in from the drawn-out position to the mid-course position, by switching the sliders (that is, one slider is in the case restraint released position, and the other slider is in the case restrained position) from the case restraint released position to the case restrained position by means of the strikers (the urging device accumulates force in this process), the force accumulated in the urging device is held. In addition, by switching the sliders from the case restrained position to the case restraint released position, the movable body slides from the mid-course position to the drawn-out position or the drawn-in position by the force accumulated in the urging device.

In other words, the essential component structure of the present invention is that the drawing-out/drawing-in unit main body is provided on one of the main body and the movable body, and the strikers which move the lock members in the direction roughly orthogonal to the sliding direction of the movable body to couple/uncouple with the coupling part are provided on the other. When the sliders are in the case restrained position and the case restraint released position, the force of the urging device is released or capable of accumulating the force. When both of the sliders are in the case restrained position, the force accumulated in the urging device is held (maintained).

In the present invention, at the case restrained position, one of the sliders is integrally linked to the case and does not slide independently (a locked position in which one of the sliders is integrally linked or operationally linked with the movable body). At the case restraint released position, one of the sliders is not linked to the case and is capable of sliding independently (an unlocked position in which the slider is unlinked with the movable body or released). Each lock member and each striker may be formed in a same shape, thereby shearing parts and reducing cost.

In the present invention, each of the sliders may have a holding part at one end side thereof for holding the lock members in a direction roughly orthogonal to the sliding direction of the slider. The case may have a groove in a side surface thereof so that the front end side of each of the lock members protrudes through the groove.

The striker may have a first operation part contacting the front ends of the lock members to engage and disengage the lock members with the coupling part, and a second operation part for passing one of the lock members when the other of the lock members moves in the drawing-in direction in the unlocked state, and not passing one of the lock members when the one of the lock members moves in the drawing-out direction after the one of the lock members passes.

The urging device may be a coil-type spring member having one end fixed to one of the sliders, a mid-course part bent back through a roundabout part provided on the one slider, and the other end fixed to the other of the sliders. Each of the sliders may include a rack extending in the sliding direction at opposing positions. The slider may be damped with a damper device having a gear engaging the racks of the sliders.

According to the present invention, the sliding assisting apparatus has the following advantages.

With the drawing-out/drawing-in unit main body and the strikers, it is possible to slide respectively to the final drawn-out position and the final drawnin position automatically by the force of the urging device, in the process of switching the movable body from the drawn-in position to the drawn-out position, and in the process of switching the movable body from the drawn-out position to the drawn-in position, that is, from each mid-course position, thereby improving convenience. Because both assisting functions of drawing in and drawing out can be achieved by the single unit construction, it becomes advantageous in a sense of that it has excellent building-in characteristics and maintenance characteristics, and it tends not to be limited in setup space.

Because the front end sides of the respective lock members are made to protrude out toward the same direction from the long groove on the case in a state in which the respective sliders hold the lock members in the holding parts, compactness is achieved, and flexibility as to where to install is obtained, for example, compared with a construction in which the respective lock members are made to protrude out from different side surfaces.

Even when the movable body is removed from the main body side and furthermore the lock members are shifted to different positions from when they were removed, it is made possible to restore to normal driving along with setting on the main body side.

Even if the urging device is a coil-type spring member that is cheaper than a constant-pressure spring, by interposing the roundabout part, the friction during spring operation can be eliminated, and in addition, an effective layout can be realized.

The apparatus has excellent simplicity as a construction in which the movable body is damped by the damper such that it is not rapidly slid by the force of the urging device, the damping force can be applied stably by means of the gear, and making the damping force act on only a part of the course of sliding of the sliders also becomes easier to realize.

DETAILED DESCRIPTION OF PREFERRED EMBODIMENTS

Figure 1:
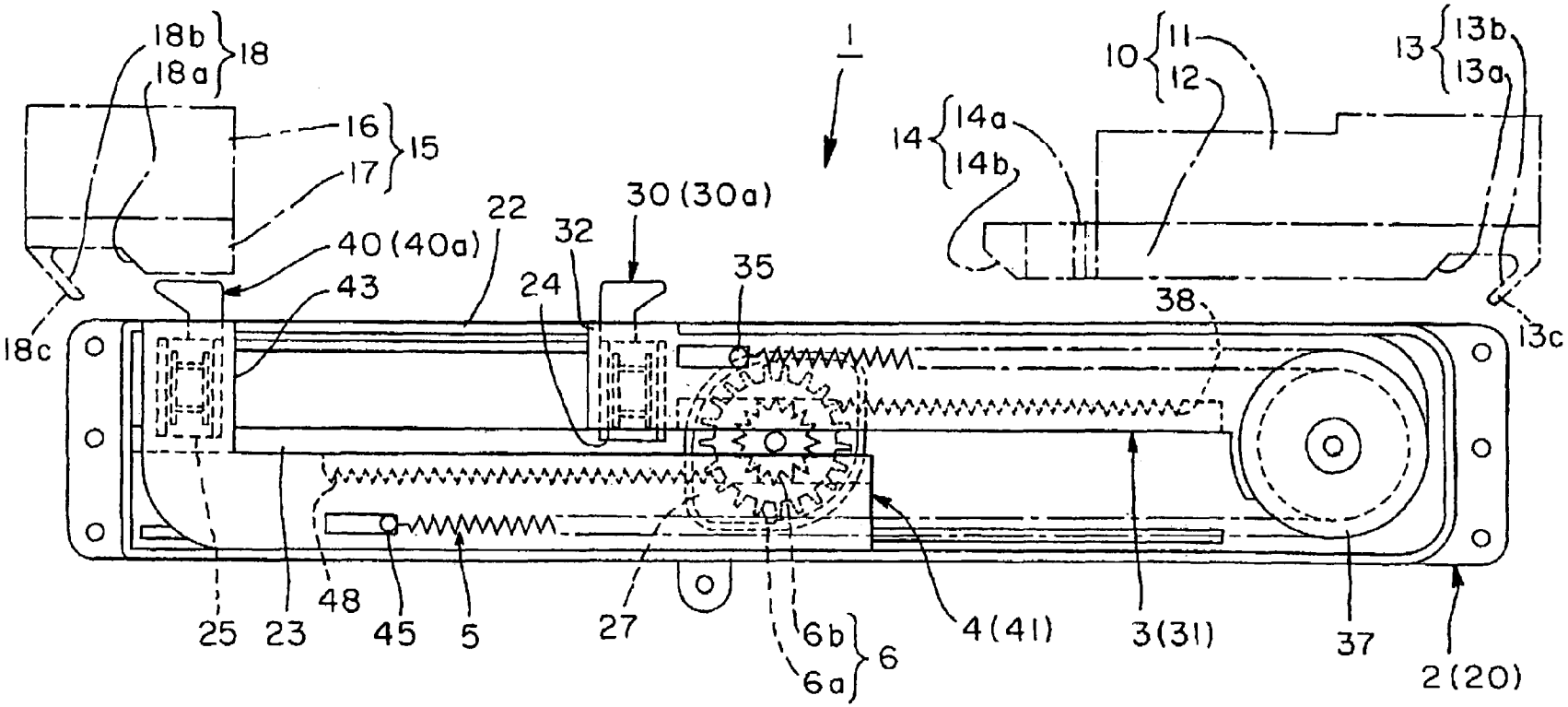
FIG. 1 is a drawing typically showing operational characteristics (force accumulating state) of an embodiment of the present invention.
Figures 2A, 2B:
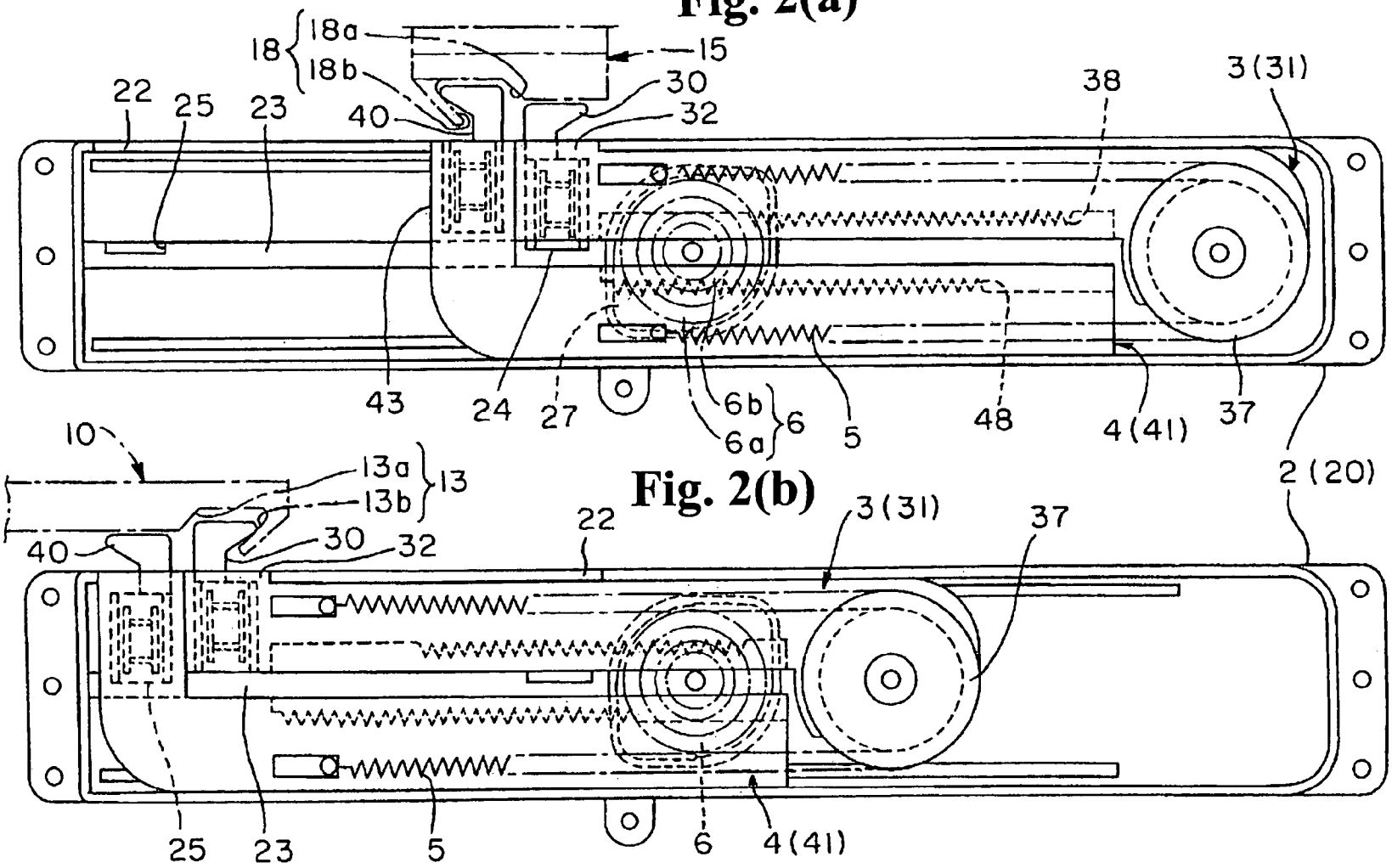
FIGS. 2(*a*) and 2(*b*) are drawings typically showing the operational characteristics (force releasing state) of an embodiment of the present invention.
Figure 3:
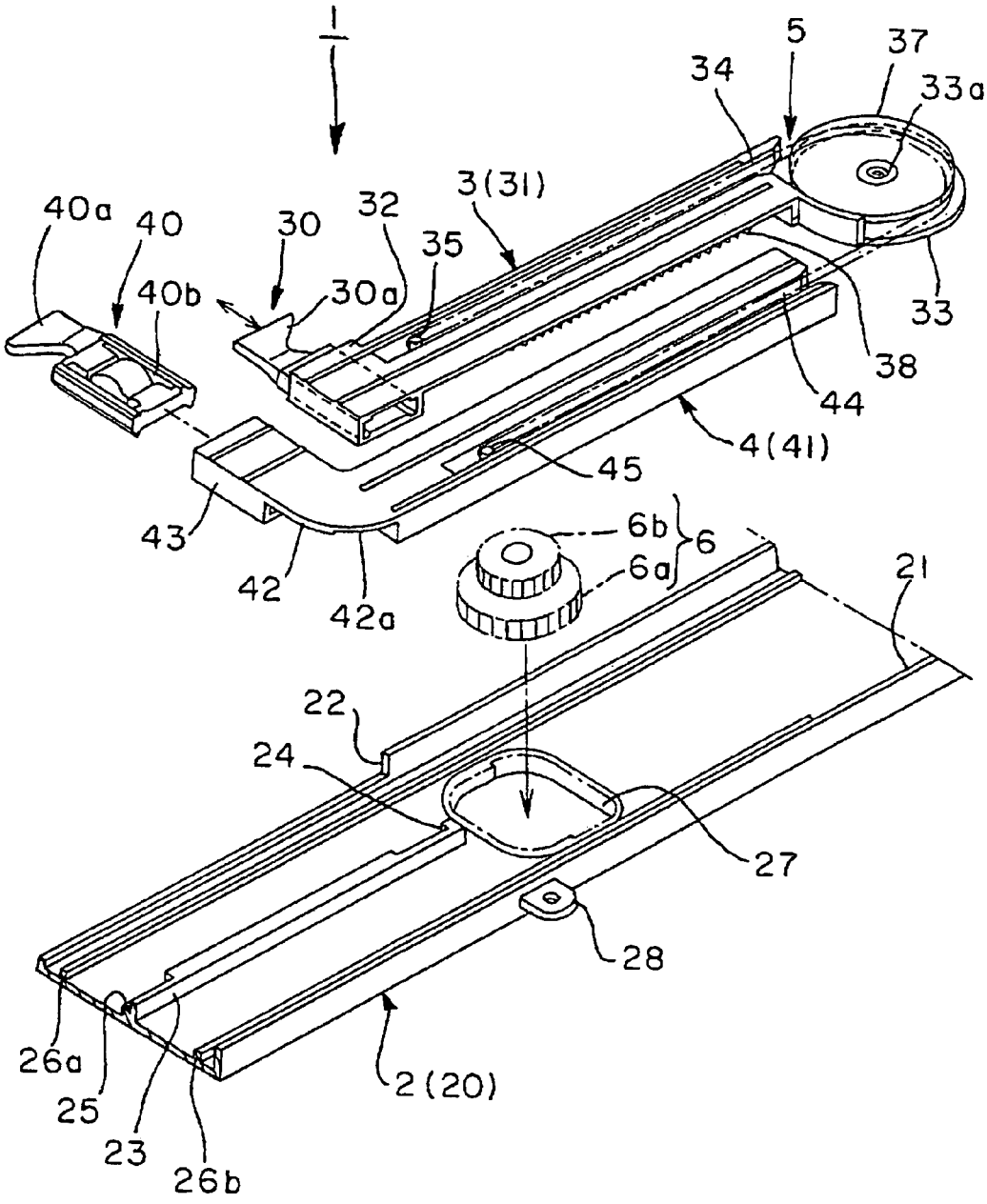
FIG. 3 is an exploded perspective view showing the relationships among the main members of the sliding assisting apparatus in FIG. 1.
Figure 4A:
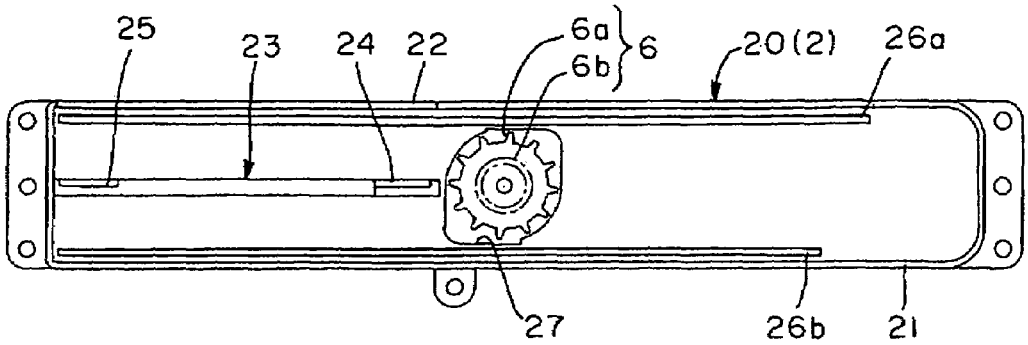
FIGS. 4(*a*) and 4(*b*) are views showing the main body of the case constituting the above sliding assisting apparatus.
Figure 4B:
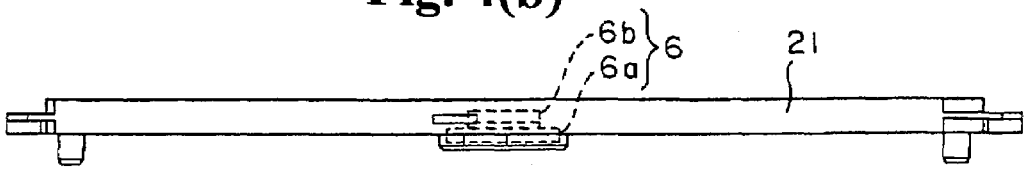
Figure 5:
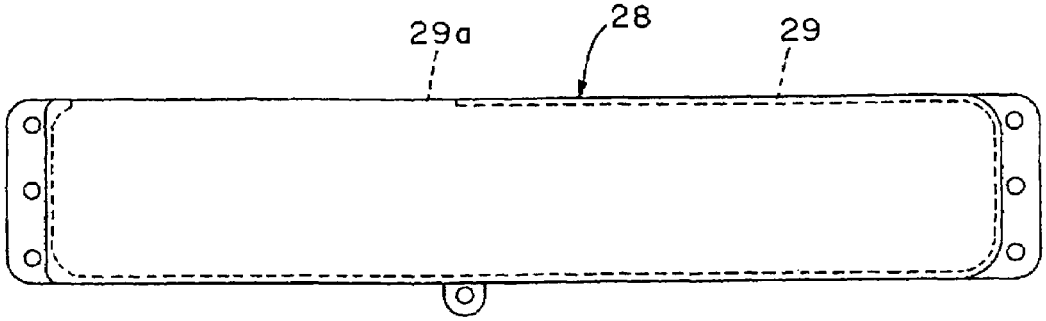
FIG. 5 is a drawing showing the cover of the above case.

Hereunder, embodiments of the present invention will be explained with reference to the drawings. FIG. 1 and FIGS. 2(*a*) and 2(*b*) typically show the operation of the apparatus of the embodiment of the present invention. FIG. 1 is the state in which force is accumulated. FIGS. 2(*a*) and 2(*b*) are showing the state in which the force is released. FIG. 3 is structural drawings showing the relationships among the main components constituting said apparatus. FIGS. 4(*a*) and 4(*b*) are a top view and a side view showing the case main body of the apparatus together with the damper. FIG. 5 is a top view showing the cover attached to said case main body.

Figure 6A:
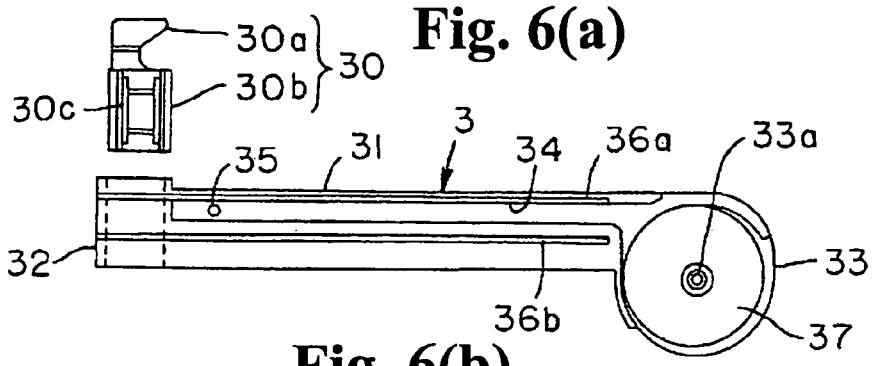
FIGS. 6(*a*) to 6(*c*) are views showing one slider constituting the above sliding assisting apparatus.
Figure 6B:
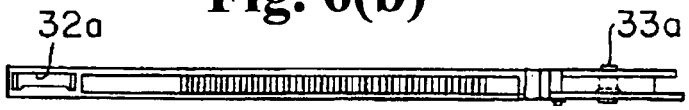
Figure 6C:
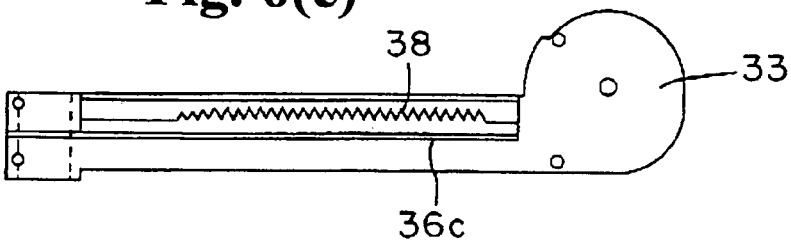
Figure 7A:
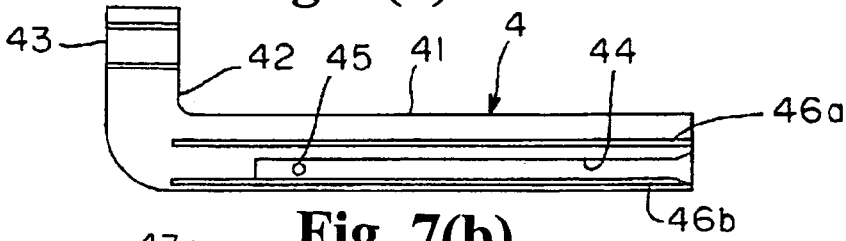
FIGS. 7(*a*) to 7(*c*) are views showing the other slider constituting the above sliding assisting apparatus.
Figure 7B:
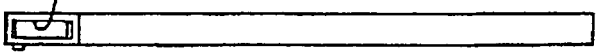
Figure 7C:
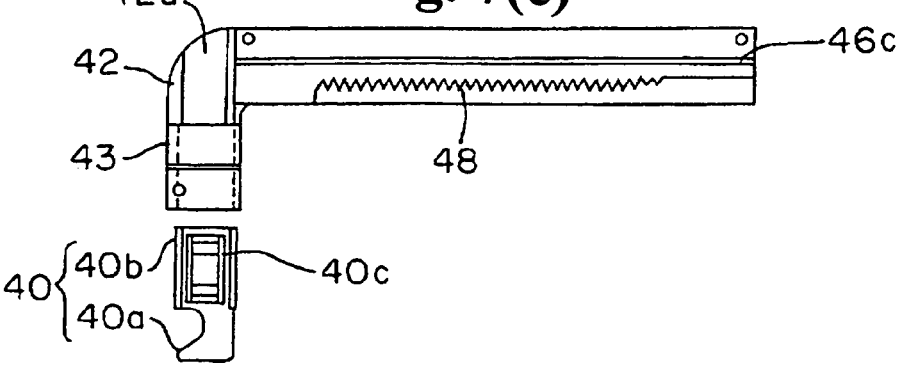
Figure 8A:
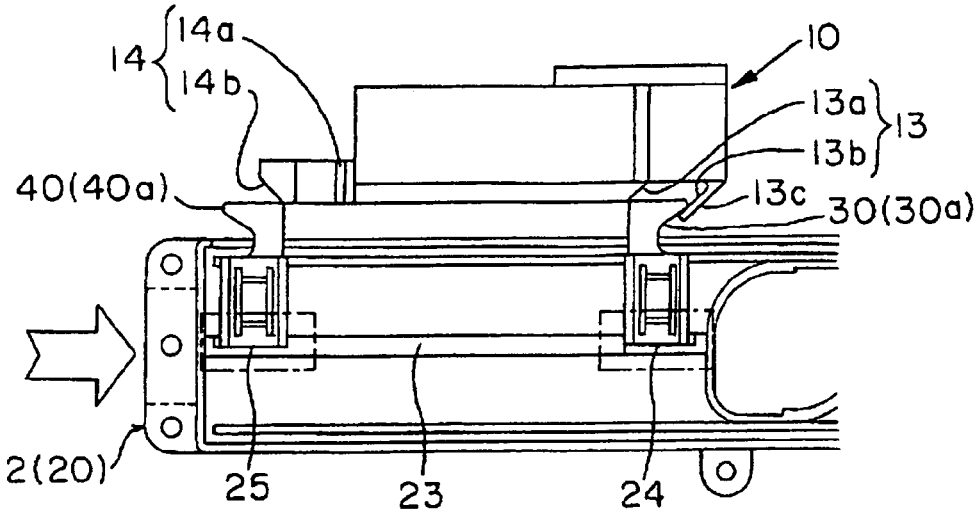
FIGS. 8(*a*) to 8(*c*) are views showing the principle when releasing restraint of the slider from the above case.
Figure 8B:
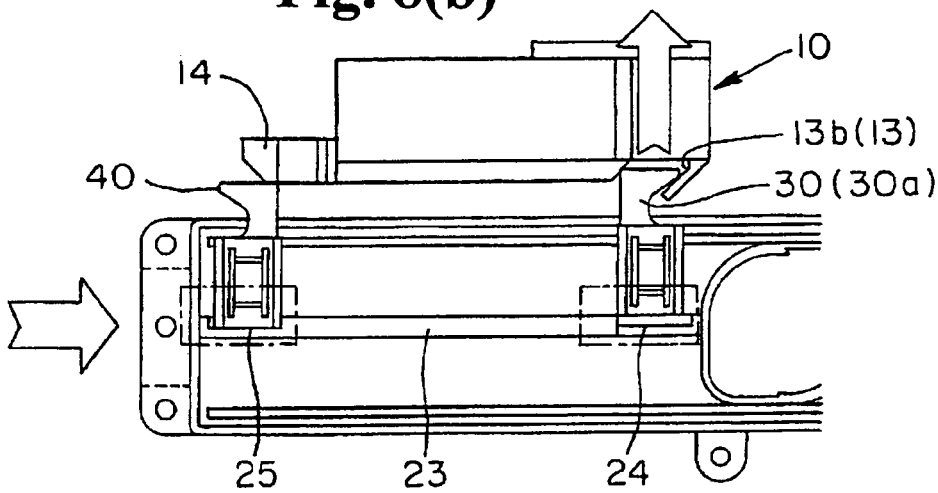
Figure 8C:
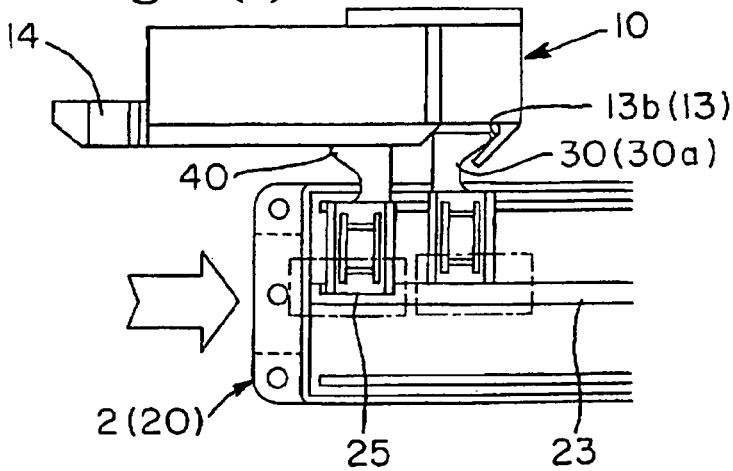

FIGS. 6(*a*) to 6(*c*) are one of the sliders constituting said apparatus; wherein FIG. 6(*a*) is a top view showing it together with the lock member, FIG. 6(*b*) is a side view, and FIG. 6(*c*) is a bottom view. FIGS. 7(*a*) to 7(*c*) are views showing the other slider; wherein FIG. 7(*a*) is a top view, FIG. 7(*b*) is a side view, and FIG. 7(*c*) is a bottom view showing it together with the lock member. FIGS. 8(*a*) to 8(*c*) and FIGS. 9(*a*) to 9(*c*) are theoretical drawings in which the sliders are restrained to the case and are released. FIGS. 10(*a*) to 10(*d*) and FIGS. 11(*a*) to 11(*d*) are drawings showing the fundamental operations when using the apparatus. FIGS. 12(*a*) to 12(*c*) are drawings when the removed movable body is assembled onto the main body. In the drawings, particularly FIG. 1, FIGS. 2(*a*) and 2(*b*), and FIGS. 8(*a*) to 8(*c*) to FIG. 13 a part is omitted in order to make the operation easier to understand. In the explanation below, after outlining an example of use of the sliding assisting apparatus, it is described in detail in the order of apparatus structure and operations.

Figure 13:
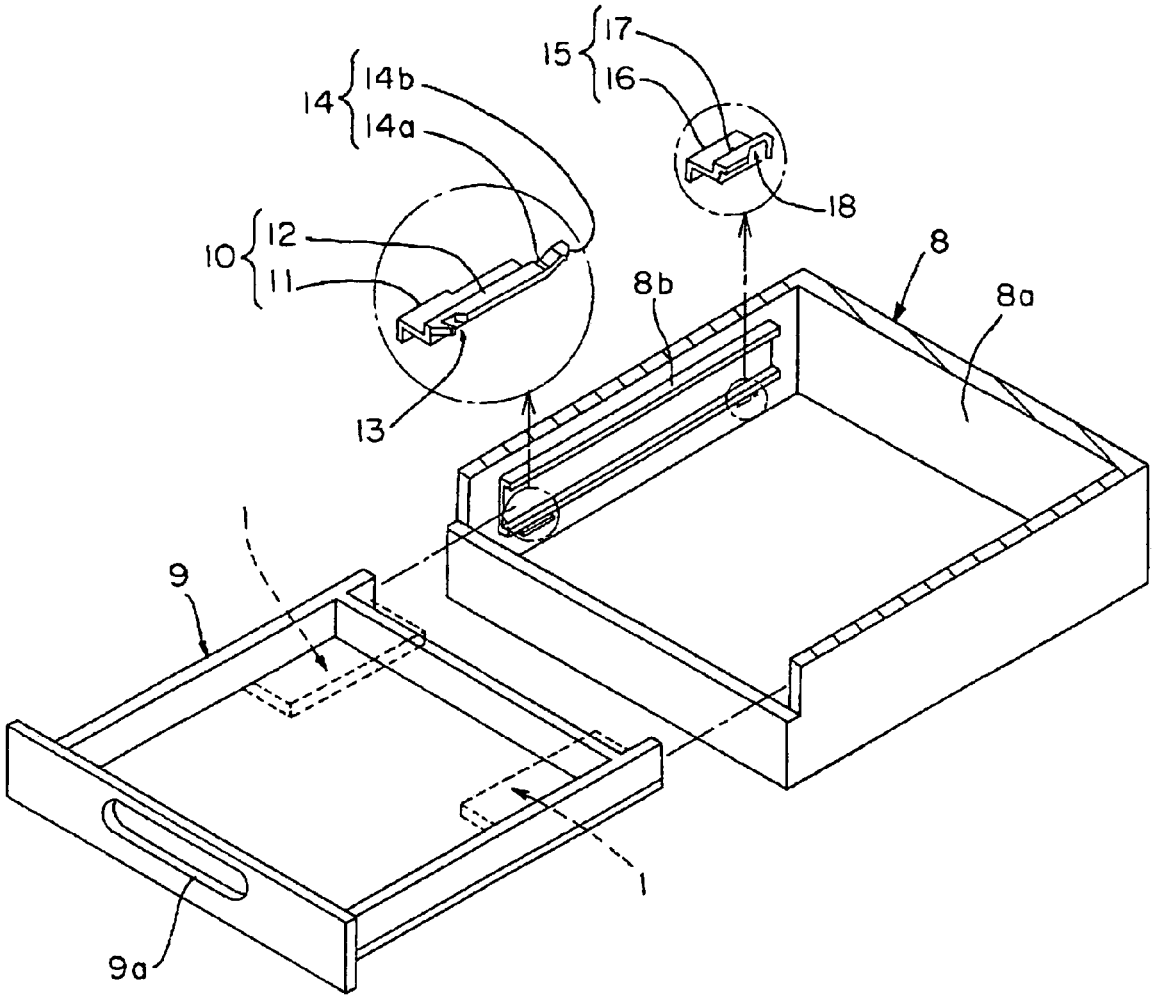
FIG. 13 is a reference drawing showing the relationship between the movable body of an embodiment of the present invention and the main body on the side of a machine.
Figure 14A:
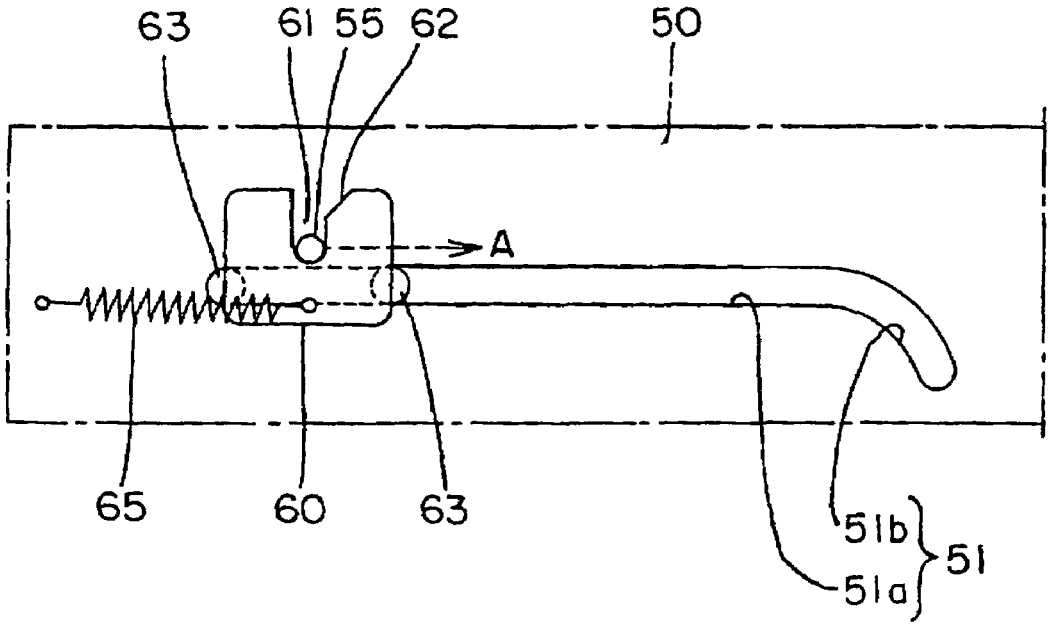
Fig. 14(a) Prior Art
FIGS. 14(*a*) and 14(*b*) are views for explaining the problems of a conventional apparatus.
Figure 14B:
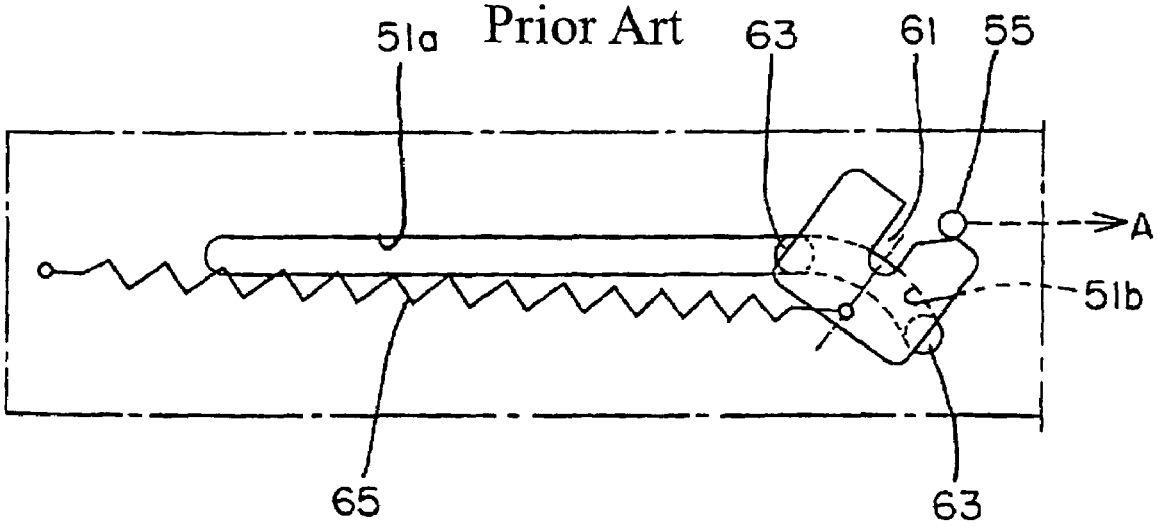
Fig. 14(b) Prior Art

The sliding assisting apparatus of the present invention is constituted as an assembly of a drawing-out/drawing-in unit main body 1 and strikers 10, 15, and it assists the operation of switching a movable body such as a tray or a lid to slide between a drawn-in position and a drawn-out position on a main body on the side of a machine. FIG. 13 shows one example of a concrete main body and movable body. Symbol 8 is the main body on the side of the machine. That main body 8 is assumed to be the corresponding part of a photocopier or system kitchen, or the like, in which a space part 8*a* having the front face open is formed. Symbol 9 is the movable body corresponding to the space part 8*a*. That movable body 9 is a drawer member having a slit 9*a*, or the like, for placing a finger, or the like, on the front wall, and it is slid forward and backward following a guide rail 8*b* attached on the inside surface of the space part 8*a*. Also, in this embodiment, drawing-out/drawing-in unit main bodies 1 are respectively attached on both sides at the rear on the bottom of the movable body 9, and in addition, a striker 10, 15 is attached on the side of the guide rail 9 in correspondence with each drawing-out/drawing-in unit main body 1.

However, in principle, it is possible also to attach the drawing-out/drawing-in unit 1 on the main body 8, and to attach the strikers 10, 15 to the movable body 9. Although it is an example in which the number of groups used is two sets (two drawing-out/drawing-in unit main bodies 1 and two pairs of strikers 10, 15), for example, there is no problem even with one set if the movable body 9 is light and small. Between the main body 8 and the movable body 9, it is not limited to a guide rail 8*b*, and it also may be that another rail structure for guiding is used.

The drawing-out/drawing-in unit main body 1 is constituted by two sliders 3, 4 which are disposed inside a case 2 and are capable of sliding respectively toward the same direction as the movable body 9, a spring member 5 which is interposed between the two sliders 3, 4 and becomes capable of accumulating force when the sliders move relatively apart from each other, a damper 6 which damps the sliding speed of the movable body 9 via the sliders 3, 4, and lock members 30, 40 which are built into the respective sliders 3, 4 and are capable of moving in displacement toward a direction roughly orthogonal to the sliding direction of the movable body 9. The detailed parts are as follows.

The case 2 consists of a main body 20 and a cover 28 as in FIG. 3-FIG. 5, and it has a rectangular container shape that is flat and long in the sliding direction of the movable body 9. Here, the main body 20 partitions the inside with frame-like vertical walls 21, and also, one of the vertical walls which are opposite in the longitudinal direction is cut open from about the middle front to back up to the back end to form a step 22. That step 22 becomes a long groove which is open on the side of the case when viewed as a case 2.

On the inside bottom partitioned by the vertical walls 21, there are formed a guide rib 23 which is positioned in about the middle in the width direction and extends from the back side (left side in FIGS. 4(*a*) and 4(*b*)) to about the middle front to back, support ribs 26*a*, 26*b* which are positioned near both sides and extend from the back side to a little before the front side (right side in FIGS. 4(*a*) and 4(*b*)), and a recessed part 27 for damper placement having a recessed shape which is positioned between the support ribs 26*a*, 26*b* up to about the middle front to back. Coupling parts 24, 25 are provided on front and back parts of the guide rib 23. Each coupling part 24, 25 has a recessed shape on the side of the guide rib 23 opposite the step 22. A lock member 30 couples/uncouples with the coupling part 24, and a lock member 40 couples/uncouples with the coupling part 25. The recessed part 27 forms a damper receiving part, and the inner perimeter surface becomes a stepped part to enable the damper 6 (main body 6*a* thereof) described later to rotate only in one direction.

The shape of the recessed part 27, for example, also may be designed to a shape having rotated the one illustrated by about 90 degrees. The above main body 20 is covered with a cover 28 after placing the sliders 3, 4 and the spring member 5 inside. In this case, the cover 28 has a vertical wall 29 corresponding to the vertical wall 21 and a step 29*a* corresponding to the step 22, and it is integrated with the main body 20 by a suitable coupling means. The above case 2, for example, also may have the main body 20 and the cover 28 integrally formed by means of a thin hinge part.

Here, the damper 6 has at least a main body 6*a* which has plural teeth (also may be protrusions) formed on the outer perimeter and is filled inside with operating oil, and a gear 6*b* which is supported to rotate freely on the main body 6*a* by means of a shaft, or the like, and is subject to resistance of said operating oil, and for example, when it rotates clockwise, it idles (the main body 6*a* idle rotates inside the recessed part 27), and when it rotates counterclockwise, the main body 6*a* becomes incapable of rotation due to the inner perimeter shape of the recessed part 27 and it damps the member on the other side (slider) by means of the gear 6*b*.

In other words, this structure cannot have damping action when the main body 6*a* rotates, and it becomes capable of damping by means of the gear 6*b* in the state being incapable of rotation. Also, the above damper 6, in relation to each slider 3, 4 described later, is attached in a manner such that the gear 6*b* is disposed between racks 38, and 48 of each slider 3, and 4, and in addition, it normally engages with one of the two racks 38, and 48.

The respective sliders 3, 4 are disposed in parallel inside the case main body 20, and they become in a relationship in which the two relatively approach and move away from each other (capable of movement in the vertical direction in the FIG. 1) Here, the slider 3 has a holding part 32 which is provided on-one end side of a long piece part 31 and partitions a through-hole 32*a* which runs through in the width direction, a disk part 33 which is provided on the other end side, a groove-shaped spring placement part 34 and sliding ribs 36*a*, 36*b* which are provided in the longitudinal direction on the upper side of the long piece part 31, a shaft 35 for anchoring which is provided inside the spring placement part 34, a pulley 37 for spring guiding which is attached to rotate freely on the disk part 33 by means of a shaft 33*a*, a rack 38 which is provided following a step formed in the longitudinal direction on the underside of the long piece part 31, a sliding rib 36*c* which is provided in the longitudinal direction on the underside of the long piece part 31, and the like.

Also, the slider 3 is disposed inside the case main body 20 between the guide rib 23 and a vertical wall part of the vertical wall 21 on the side of the step 22, in a state in which the lock member 30 is inserted into the hole 32*a* and is supported to be capable of movement against the holding part 32, and it is slid freely a sufficient distance between a forward position in which the holding part 32 is in contact with the front end surface of the step 22 as in FIG. 1 and FIG. 2(*a*), and a backward position in which it is in contact with the rear end surface of the step 22 with the holder 43 of the slider 4 in between as in FIG. 2(*b*).

Also, said lock member 30 consists of a front end claw 30*a* which is disposed outside the holding part 32, and a main body part 30*b* which is inserted into the hole 32*a*. The main body part 30*b* is furnished with elasticity in the width direction by means of plural slits 30*c*, and it is inserted to be capable of moving in displacement against the hole 32*a*. Also, the above slider 3 is switched between a case restrained position in which the lock member 30 has entered deeply into the hole 32*a* and the rear end of the main body part 30*b* is locked by the coupling part 24 of the guide rib 23 as in FIG. 1 and FIG. 2(*a*), and a case restraint released position in which the amount by which the lock member 30 protrudes from the hole 32*a* is increased and it is removed from the coupling part 24 as in FIG. 2(*b*).

As opposed to this, the slider 4 has a holding part 43 which is provided on one end side of a long piece part 41 with a thin plate-shaped bent part 42 in between and partitions a through-hole 43*a* which runs through in the width direction, a groove-shaped spring placement part 44 and sliding ribs 46*a*, 46*b* which are provided in the longitudinal direction on the upper side of the long piece part 41, a shaft 45 for anchoring which is provided inside the spring placement part 44, a rack 48 which is provided following a step formed in the longitudinal direction on the underside of the long piece part 41, a sliding rib 46*c* which is provided in the longitudinal direction on the underside of the long piece part 41, a guide groove 42*a* which is provided on the underside of the bent part 42 and continues with the corresponding inner surface of the hole 43*a*, and the like.

Also, the slider 4 is disposed inside the case main body 20 between the guide rib 23 and a corresponding vertical wall part of the vertical wall 21, in a state in which the lock member 40 is inserted into the hole 43*a* and is supported to be capable of movement against the holding part 43, and it is slid freely a sufficient distance between a backward position in which the holding part 43 is in contact with the rear end surface of the step 22 as in FIG. 1 and FIG. 2(*b*), and a forward position in which it is in contact with the front end surface of the step 22 with the holder 32 of the slider 3 in between as in FIG. 2(*a*).

Also, said lock member 40 consists of a front end claw 40*a* which is disposed outside the holding part 43, and a main body part 40*b* which is inserted into the hole 43*a*. The main body part 40*b* is furnished with elasticity in the width direction by means of plural slits 40*c*, and it is inserted to be capable of moving in displacement against the hole 43*a*. Also, the above slider 4 is switched between a case restrained position in which the lock member 40 has entered deeply into the hole 43*a* and the rear end of the main body part 40*b* is locked by the coupling part 25 of the guide rib 23 as in FIG. 1 and FIG. 2(*b*), and a case restraint released position in which the amount by which the lock member 40 protrudes from the hole 43*a* is increased and it is removed from the coupling part 25 as in FIG. 2(*a*).

For the spring member 5, a coil-type spring member is used. One end is fixed to the shaft 35 on the side of the slider 3, the mid-course part is placed from the spring placement part 34 to the spring placement part 44 by way of the pulley 37, and the other end is fixed to the shaft 45 on the side of the slider 4. Also, the spring member 5 accumulates force when the two sliders 3, 4 are slid so as to move relatively away from each other as in FIG. 1, that force is held when both sliders 3, 4 are in the case restrained position, and the force is released when the sliders 3, 4 are slid so as to approach each other as in FIGS. 2(*a*) and 2(*b*).

When the force is released, one of the sliders 3, 4 is switched to the case restrained position, and the other is switched to the case restraint released position. With a spring member 5 such as above, because the total length is long, a stabilized spring load can be obtained, and by interposing the pulley 37 between both sliders 3, 4, the friction during spring action can be eliminated, and also an efficient layout can be realized. Moreover, it becomes simpler and more advantageous in terms of cost than a constant-force spring or constant-pressure spring in which a spring plate wound around a spool is drawn out from a housing.

The striker 10 is a member that switches the lock member 30 on the slider 3 side between the case restrained position and the case restraint released position, and also controls so that the movable body 9 does not easily come out from the main body 8 when it is drawn out in the case restraint released position of the slider 3 as in FIG. 2(*b*) and FIG. 10(*d*). In terms of shape, as shown in FIG. 1 and FIG. 13, it has an attachment part 11 to the side of the main body 8, a guide part 12 which follows one side surface of the attachment part 11 and becomes one level higher, a first operation part 13 which is provided on the front side surface of the guide part 12, and a second operation part 14 which is provided extending toward the direction of the rear end of the guide part 12 and is capable of rocking in the vertical direction.

The first operation part 13 has a size capable of receiving the front end claw 30*a* of the lock member 30, and it has cam surfaces 13*a*, 13*b* placed oppositely front and back. The cam surface 13*a* is positioned on the rear side. The cam surface 13*b* is formed by the inner surface of an elastically deformable tongue piece part 13*c* which is placed protruding from the guide part 12. The second operation part 14 is provided extending on the guide part 12 by means of a thin part 14*a*, and the front end side becomes slightly higher than the guide part 12. A tapered sloping part 14*b*, which becomes thinner as it goes forward, is provided on that front end. FIGS. 8(*a*) to 8(*c*) to FIGS. 11(*a*) to 11(*d*) show the striker 10 from the lower angle, and FIGS. 12(*a*) to 12(*d*) show the striker 10 from the upper angle.

As opposed to this, the striker 15 is a member that switches the lock member 40 on the slider 4 side between the case restrained position and the case restraint released position, and also controls so that the movable body 9 does not enter too far into the space part 8*a* of the main body 8 in the case restraint released position of the slider 4 as in FIG. 2(*a*) and FIG. 11(*d*). In terms of shape, as shown in FIG. 1 and FIG. 13, it has an attachment part 16 to the side of the main body 8, a guide part 17 which follows one side surface of the attachment part 16 and becomes one level higher, and an operation part 18 which is provided on the outside surface of the guide part 17.

The operation part 18 has a size capable of receiving the front end claw 40*a* of the lock member 40, and it has cam surfaces 18*a*, 18*b* placed oppositely front and back. The cam surface 18*a* is positioned on the front side. The cam surface 18*b* is formed by the inner surface of an elastically deformable tongue piece part 18*c*, and it is placed protruding on the outside surface of the guide part 17. Although the apparatus of the present invention operates correctly even when the strikers 10, 15 are made the same shape, that is, the shape of the striker 10 or the shape of the striker 15 described above, the operation 4 described later can be realized by making them custom parts as in this embodiment.

FIG. 1 and FIGS. 2(*a*) and 2(*b*) show the state in which force was accumulated by the spring member 5, and the state in which it was released for sliding, as fundamental operations of the above sliding assisting apparatus. Here, the two sliders 3, 4 in FIG. 1 are in the case restrained position in which each lock member 30, 40 is locked by the corresponding coupling part 24, 25, and the two are apart from each other to the maximum extent. In this state, the spring member 5 is accumulating force proportional to the distance between the two sliders 3, 4.

FIGS. 2(*a*) and 2(*b*) show the state of the two in which that accumulated force was released. That is, FIG. 2(*a*) is the state in which the drawing-out/drawing-in unit main body 1 (movable body 9) was moved toward the left side in FIG. 1 whereby the lock member 40 on the slider 4 side was unlocked from the coupling part 25 by operation of the striker 15, and it was automatically moved toward the left side by the force of the spring member 5. FIG. 2(*b*) is the state in which the drawing-out/drawing-in unit main body 1 (movable body 9) was moved toward the right side in FIG. 1 whereby the lock member 30 on the slider 3 side was unlocked from the coupling part 24 by operation of the striker 10, and it was automatically moved toward the right side by the force of the spring member 5. In this structure, the drawing-out/drawing-in unit main body 1 (movable body 9) thus is automatically moved by the force of the spring member 5. In the course of moving, the drawing-out/drawing-in unit main body 1 (movable body 9) is moved gently, being damped by the damper 6.

Figure 9A:
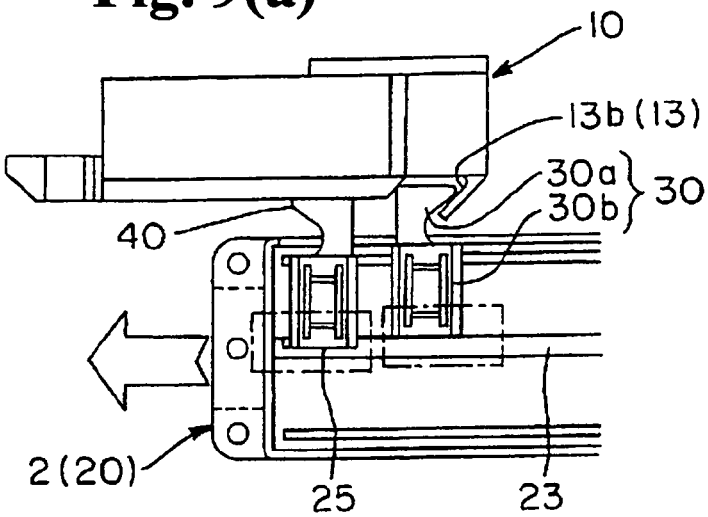
FIGS. 9(*a*) to 9(*c*) are views showing the principle when restraining the above slider to the case.
Figure 9B:
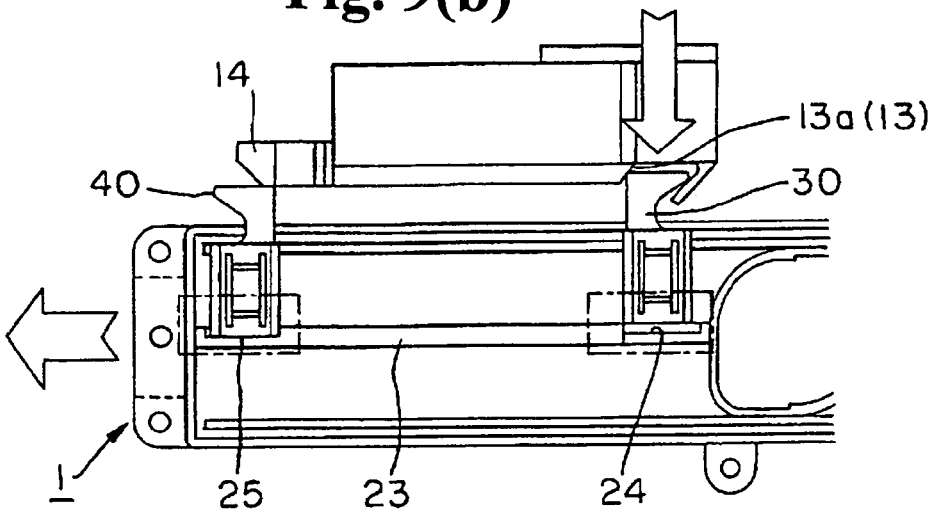
Figure 9C:
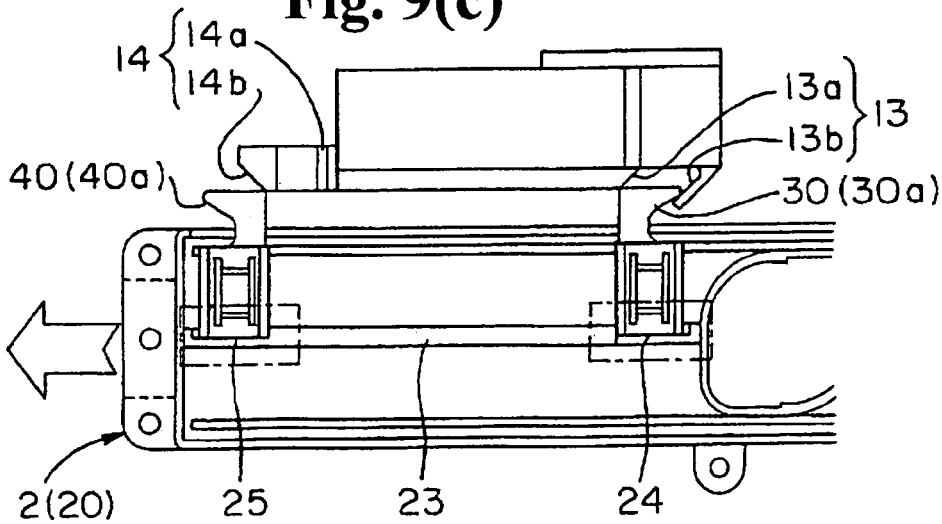
Figure 10A:
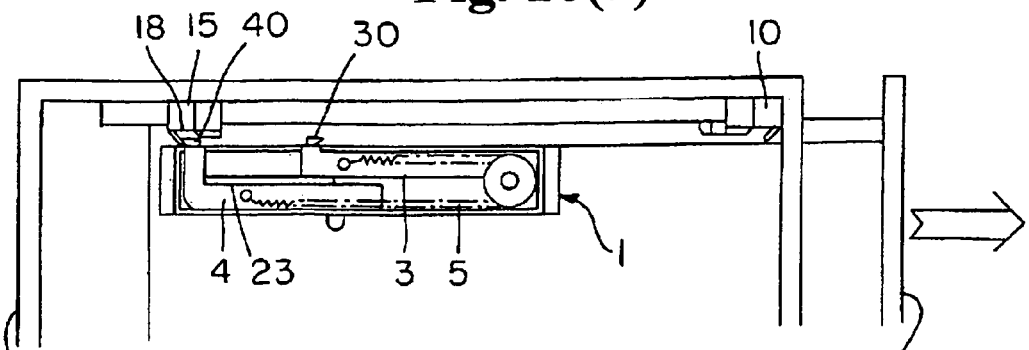
FIGS. 10(*a*) to 10(*d*) are views showing the operation (drawing-out operation) of the above sliding assisting apparatus.
Figure 10B:
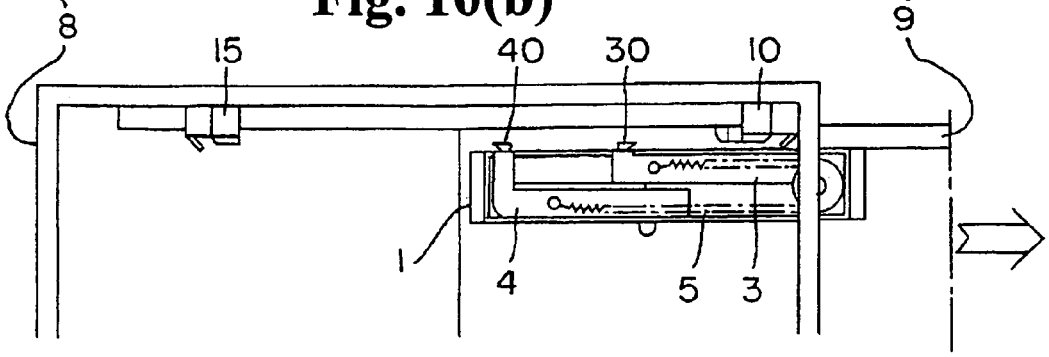
Figure 10C:
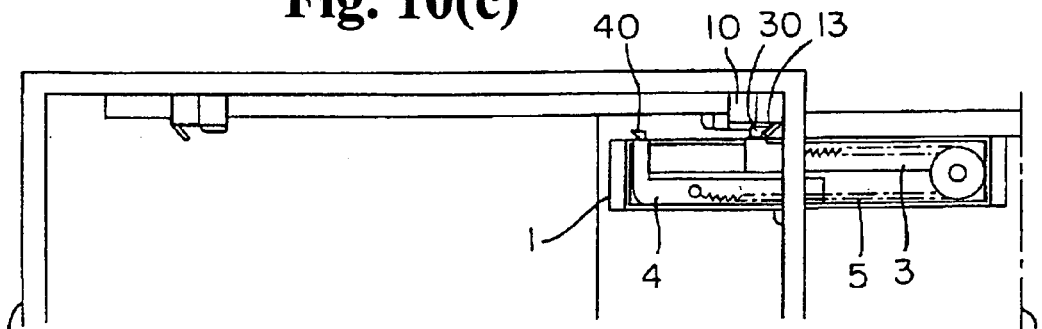
Figure 10D:
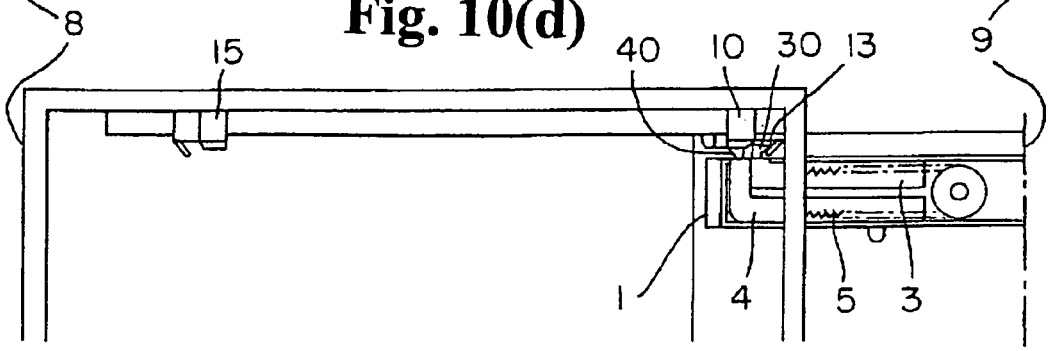
Figure 11A:
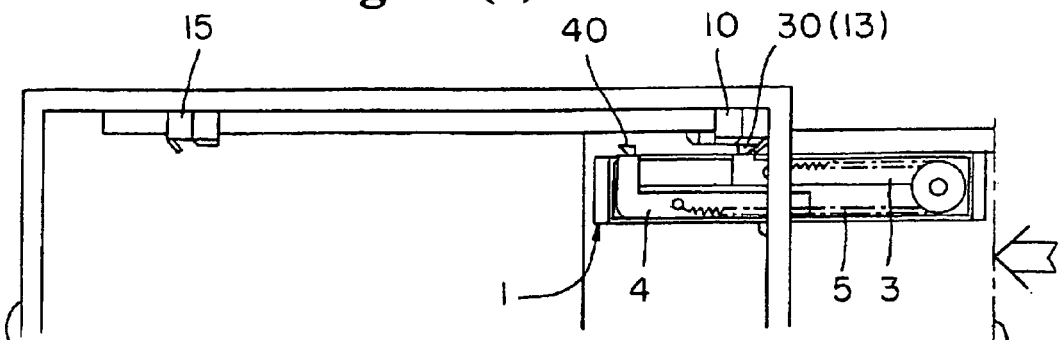
FIGS. 11(*a*) to 11(*d*) are views showing the operation (drawing-in operation) of the sliding assisting apparatus similar to FIGS. 10(*a*) to 10(*d*)
Figure 11B:
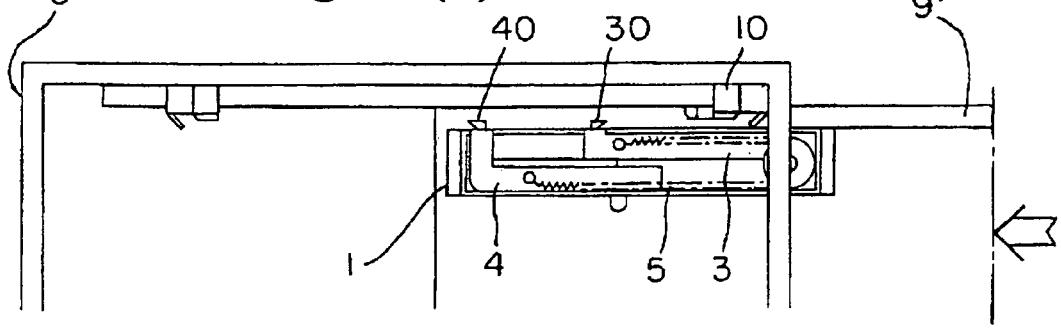
Figure 11C:
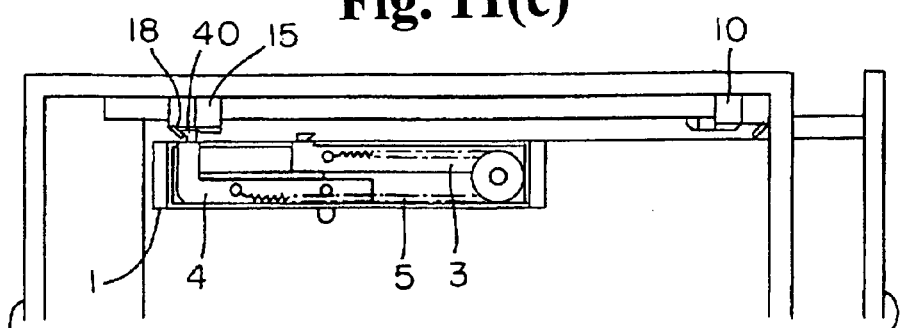
Figure 11D:
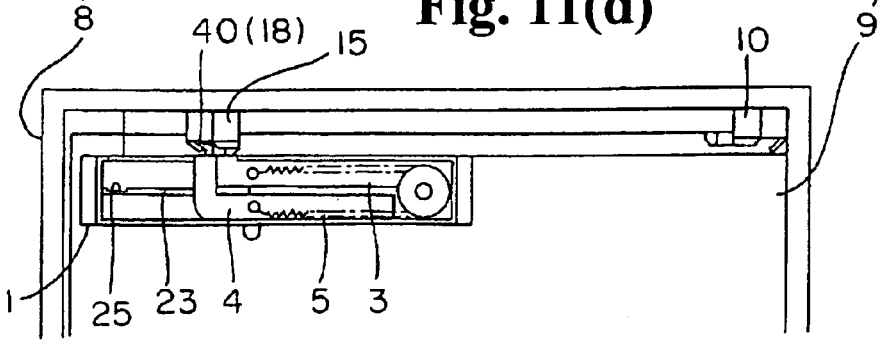
Figure 12A:
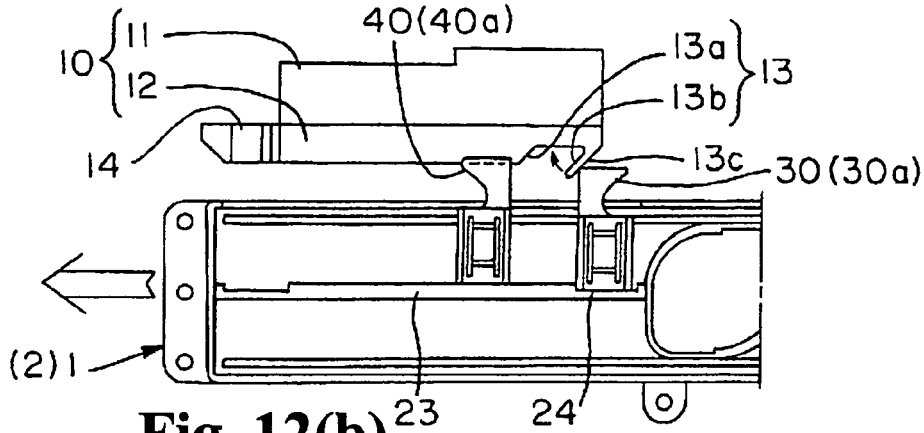
FIGS. 12(*a*) to 12(*d*) are views showing the restoration to normal driving when assembling the movable body on the main body.
Figure 12B:
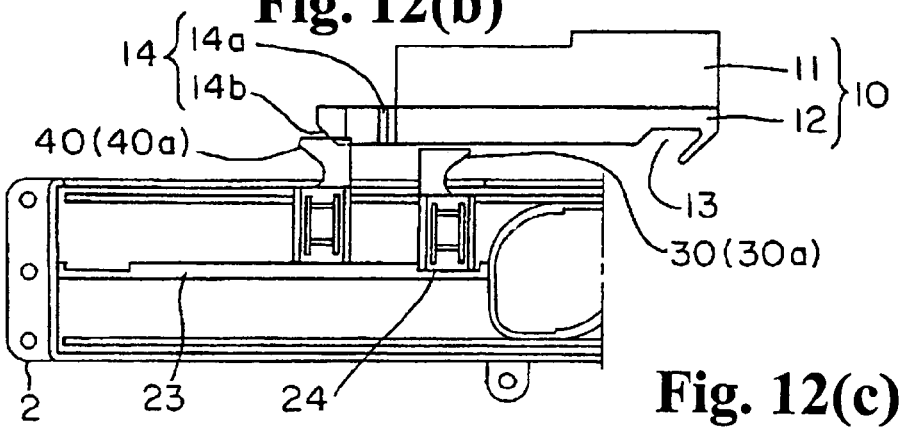
Figure 12C:
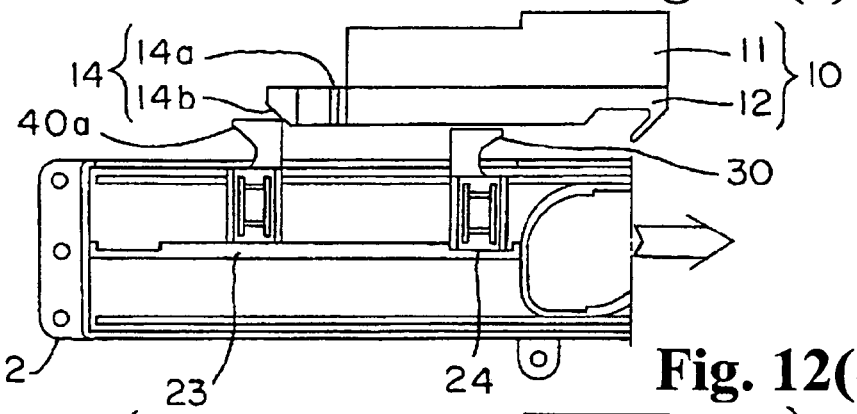
Figure 12D:
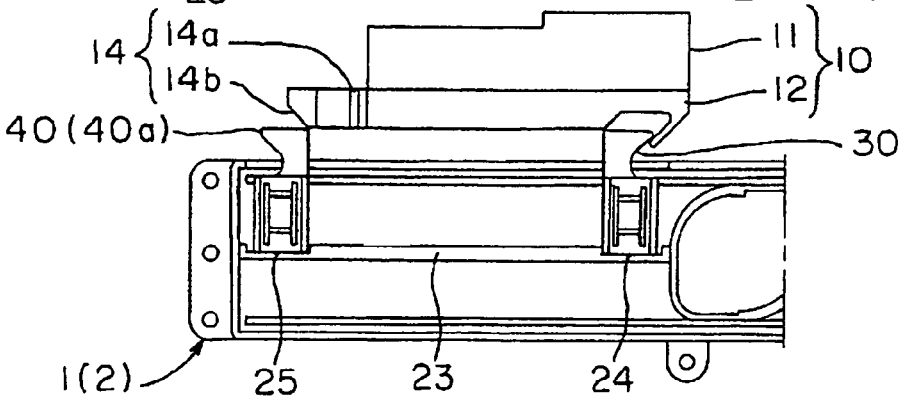

FIGS. 8(*a*) to 8(*c*) and FIGS. 9(*a*) to 9(*c*) show the movement when the above-described lock members are switched between locking and unlocking as fundamental operations of the sliding assisting apparatus.

FIGS. 8(*a*) to 8(*c*) show the movement when the lock member 30 is unlocked, that is, when the slider 30 not illustrated is released from the case 2 (same as drawing-out/drawing-in unit main body 1 or movable body 9). FIG. 8(*a*) is the state in which the case 2 was moved toward the right of FIG. 1, and the lock member 30 (front end claw 30*a* thereof) contacted with the cam surface 13*b* of the first operation part 13. FIG. 8(*b*) is the state in which the drawing-out/drawing-in unit main body 1 (movable body 9) was moved further toward the right, whereby that moving force was converted into a force pushing the lock member 30 upwardly, that is, the lock member 30 was pushed up by the stress on the front end claw 30*a* received from the cam surface 13*b*, and was unlocked from the coupling part 24. FIG. 8(*c*) is the state in which by unlocking of the lock member 30 from the coupling part 24, the slider 3 became in the case restraint released position, and as a result, the case 2 (movable body 9) was moved forward against the striker 10 by the force of the spring member 5 accumulated up to then.

As opposed to this, FIGS. 9(*a*) to 9(*c*) shows the movement when the lock member 30 is locked again, that is, when the slider 30 not illustrated is restrained to the case 2 (same as drawing-out/drawing-in unit main body 1 or movable body 9). FIG. 9(*a*) is the state immediately before the case 2 was moved toward the left side from the state in FIG. 8(*c*). FIG. 9(*b*) is the state in which the case 2 (movable body 9) was moved further toward the left while accumulating said force of the spring member 5, whereby that moving force was converted into a force pushing the lock member 30 downwardly, that is, the lock member 30 is about to be pushed down by the stress received from the cam surface 13*a*. FIG. 9(*c*) is the state in which the case 2 (movable body 9) was moved further toward the left, whereby the lock member 30 was pushed down and locked by the coupling part 24 (the slider 3 not illustrated becoming in the case restrained position), and the force of the spring member 5 accumulated up to then is being held. Although the above example is on the side of the lock member 30, the lock member 40 also is switched between FIG. 1 and FIG. 2(*a*) by the same kind of movement.

FIGS. 10(*a*) to 10(*d*) and FIGS. 11(*a*) to 11(*d*) show the operations when the movable body 9 is drawn out and drawn in from the space part 8*a* of the main body 8 on the side of the machine as an example of use of the sliding assisting apparatus. In FIGS. 10(*a*) to 10(*d*) and FIGS. 11(*a*) to 11(*d*), although symbols are assigned only to the main members, please refer to the corresponding FIG. 1 to FIGS. 7(*a*) to 7(*c*) for the detailed parts.

FIG. 10(*a*) is the state in the process of drawing outward in which the movable body 9 is being drawn out by hand from the drawn-in position where it is housed inside the space part 8*a* on the machine side as in FIG. 11(*d*) and FIG. 2(*a*). In this process, the lock member 30 of one slider 3 of the sliders 3, 4 of the drawing-in/drawing-out unit main body 1 is in the locked state, and the lock member 40 of the slider 4 is locked by the coupling part 25 while contacting the front end claw 40*a* to the cam surface 18*a* of the operation part 18 from the unlocked state in FIG. 2(*a*). That is, because the movable body 9 is drawn out while idling the damper 6, and also because the slider 3 is in the case restrained position, the spring member 5 accumulates force increasingly accompanying the sliding of the movable body 9. Also, the accumulated force is held just as in FIG. 1 when the lock member 40 was switched to the locked state.

FIG. 10(*b*) shows the state in which the movable body 9 is being further drawn outward in the state in which the force thus accumulated was held (that is, the spring member 5 is neutral). FIG. 10(*c*) shows the state in which the movable body 9 was further drawn out and immediately after the lock member 30 of the slider 3 was switched to unlocked by the striker 10. In this process, being the same as in FIGS. 8(*a*) to 8(*c*), the lock member 30 contacts the cam surface 13*b* of the first operation part 13 of the striker 10 through the front end claw 30*a*, and it is pushed up by means of the front end claw 30*a* by the recoil or cam action received from that cam surface 13*b*, and as a result, it is unlocked from the coupling part 24.

FIG. 10(*d*) is the state in which by unlocking of the lock member 30 thus, that is, by switching of the slider 3 to the case restraint released position, the movable body 9 was slid automatically up to the final drawn-out position by the force of the spring member 5 just as in FIG. 2(*b*). In this structure, while going from (c)-(d), the damper 6 damps the sliding speed of the movable body 9 via the engagement between the rack 48 of the slider 4 and the gear 6*b*. As a result, the movable body 9 comes to be slid at a gentle speed from the mid-course position up to the final drawn-out position.

FIG. 11(*a*) shows the state when the movable body 9 was operated to be drawn inward from the drawn-out position in FIG. 10(*d*) to the mid-course position. In this process of drawing inward, because the lock member 40 is in the locked position (the slider 4 is in the case restrained position) and the lock member 30 is in the unlocked position (the slider 3 is in the case restraint released position), the spring member 5 accumulates force increasingly accompanying the sliding of the movable body 9. Also, when the lock member 30 becomes opposite the coupling part 24 just as in FIGS. 9(*b*) and 9(*c*), it is pushed down by the stress on the front end claw 30*a* received from the cam surface 13*a* of the first operation part 13 (the slider 3 becomes in the case restrained position), and the accumulated force of the spring member 5 is held.

FIG. 11(*b*) shows the state in which the movable body 9 is being further drawn inward in a state in which the force thus accumulated was held (that is, the spring member 5 is neutral) FIG. 11(*c*) shows the state in which the movable body 9 was operated to be drawn inward up to the mid-course position and immediately before the lock member 40 of the slider 4 was switched to unlocked by the operation part 18 of the striker 15. That is, in this process of drawing inward, the front end claw 40*a* of the lock member 40 is contacted to the cam surface 18*b* of the operation part 18 as shown on the left side in FIG. 1, and the lock member 40 is pushed upwardly in the same drawing by the stress or cam action received from that cam surface 18*b*, whereby it is unlocked from the coupling part 25.

FIG. 11(*d*) shows the state in which the movable body 9 was slid automatically up to the final drawn-in position by the force of the spring member 5 by thus switching of the lock member 40 to unlocked (the slider 4 is in the case restraint released position). In this structure, while going from (c)-(d), the damper 6 damps the sliding speed of the movable body 9 via the engagement between the rack 48 and the gear 6*b*. As a result, the movable body 9 comes to be slid at a gentle speed from the mid-course position up to the final drawn-in position.

In the above sliding assisting apparatus, the movable body 9 may be removed from the space part 8*a* of the main body 8 on the machine side in order to perform cleaning or maintenance, or the like, and it is designed so that in the event that it is thus removed and set again in the main body space part 8*a*, it can be restored assuredly to normal driving even if the lock members hit something and move.

Usually, for example, if the movable body 9 is lifted up or tilted from the state in FIG. 2(*b*) and FIG. 10(*d*) being the drawn-out position (the slider 3 is in the case restraint released position, the slider 4 is in the case restrained position), the front end claw 30*a* of the lock member 30 comes out from inside the first operation part 13 of the striker 10, and it becomes possible to remove it from the space part 8*a*.

Also, if the movable body 9 is in the same state as when it was removed from the main body 8, it is set in the space part 8*a* by performing the operation in reverse order of removing it. As a matter of fact, in the above drawing-out/drawing-in unit main body 1, it also may occur that the lock member 40 is unlocked from the coupling part 25 such as by a load when contacting the lock member 40, or the lock member 30 is unlocked from the coupling part 24, when in a state in which the movable body 9 was removed from the main body 8.

FIGS. 12(*a*) to 12(*d*) show such a situation (when the slider 4 not illustrated became in the case unrestrained position), and it explains how the movable body 9 not illustrated is set in the main body 8 and also is restored to normal operation.

FIG. 12(*a*) typically shows the state when inserting the movable body 9 into the space part 8*a* on the main body side. Here, in the drawing-out/drawing-in unit main body 1, because the lock member 40 is unlocked, it is free to slide forward together with the slider 4, and the lock member 30 is slid freely toward the same direction by that sliding. Therefore, in this structure, first, in the initial process in which the movable body 9 is inserted into the space part 8*a* on the main body side, the front end claw 40*a* of the lock member 40 is slid following the top surface of the guide part 12 of the striker 10 due to the difference of height, and in addition, the front end claw 30*a* of the lock member 30 hits the tongue piece part 13*c* and is pressed down.

As a result, the lock member 30 is locked by the coupling part 24 (the slider 3 is in the case restrained position) as in the same drawing, and the front end claw 30*a* climbs over while elastically deforming the tongue piece part 13*c* toward a collapsing direction. Also, in this structure, when the movable body 9 is further drawn in, the lock member 40 (front end claw 40*a* thereof) climbs over the second operation part 14 while bending it downwardly via the thin part 14*a* as in FIG. 12(*b*). Doing thus, the lock member 40 contacts the front end sloping surface 14*b* of the second operation part 14 on the upper hook part of the front end claw 40*a* with a clicking sound as in FIG. 12(*c*).

By forward drawing out of the drawing-out/drawing-in unit main body 1 (movable body 9) as in FIG. 12(*c*) from that state, the lock member 40 becomes in a state having been slid relatively backward (at this time, the spring member 0.5 not illustrated accumulates force), and finally it is locked with the coupling part 25 as in FIG. 12(*d*). As a result, it is restored to normal driving just as in FIG. 1 and FIG. 12(*b*) as well as FIG. 11(*b*). Thus as above, in this structure, the reliability can be improved because it can always be restored to normal driving even when the movable body 9 is removed from the main body 8 on the machine side and furthermore it is different from the manner when it was removed by receiving an external load.

The present invention is not limited to the above embodiments, and it can be suitably modified while referring to these. Also, the apparatus of the present invention has no particular limitation in terms of use, for example, if the movable body is a cover body, the drawn-in position has the same function as the closed position in which it is disposed on a prescribed place of the main body, and the drawn-out position has the same function as the open position in which it is removed from the prescribed place of the main body. Also, the damper 6 was constituted to perform damping only during rotation in one direction, and simplification was achieved by setting the shape of the main body 6*a*with respect to the recessed part 27 for damper receiving and controlling the direction of rotation, but there is no problem even if it is other than this type. Also, the spring member 5 also may be other urging structure such as a constant-pressure spring. Of course, there is no problem even if a pair of strikers is expressed as operation members, or the like. Also, as a structure, for example, a mode in which the first operation part 13 (and second operation part 14 according to need) of the striker 10 and the operation part 18 of the striker 15 respectively are formed on a single long and thin member also is included.

The disclosure of Japanese Patent Application No. 2004-213626, filed on Jul. 21, 2004, is incorporated in the application.

While the invention has been explained with reference to the specific embodiments of the invention, the explanation is illustrative and the invention is limited only by the appended claims.

What is claimed is:

1. A sliding assisting apparatus for assisting a movable body to move between a drawn-out position and a drawn-in position relative to a main body, comprising:

a drawing-out/drawing-in unit main body to be attached to one of the main body and the movable body, and including:

a case, a pair of sliders slidably disposed inside the case in a direction that the movable body moves, lock members movably supported on the respective sliders and having a front end protruding from the case, coupling parts provided on the case for engaging the lock members, and an urging device provided between the sliders for accumulating a force when one of the sliders slides away from the other; and a pair of strikers to be attached to the other of the main body and the movable body, one striker switching one slider between a case restrained position in which one coupling part engages one lock member to fix the one slider to the case and a case restraint released position in which the one coupling part releases the one lock member so that the slider slides relative to the case.

2. A sliding assisting apparatus according to claim 1, wherein each of said sliders includes a holding part at one end side thereof for holding each of the lock members in a direction perpendicular to a direction that the sliders slide, said case including a groove in a side surface thereof so that the front end of each of the lock members protrudes through the groove.

3. A sliding assisting apparatus according to claim 1, wherein each of said strikers includes a first operation part contacting the front end of each of the lock members to engage and disengage each of the lock members with the coupling part, and a second operation part for passing one of the lock members when the other of the lock members is not locked and moves in a drawing-in direction, and not passing the one of the lock members when the one of the lock members moves in a drawing-out direction after the one of the lock members passes through the second operation part.

4. A sliding assisting apparatus according to claim 1, wherein said urging device is a coil spring member having one end fixed to one of the sliders, a mid-course part curved around a round part provided on the one of the sliders, and the other end fixed to the other of the sliders.

5. A sliding assistance apparatus according to claim 1, wherein each of said sliders includes a rack extending in a direction that the sliders slide at opposing positions.

6. A sliding assistance apparatus according to claim 5, further comprising a damper device having a gear engaging the racks for damping the sliders.

7. A sliding assistance apparatus according to claim 1, wherein said pair of sliders is arranged to move close to and away from each other and is urged to be spaced apart from each other by the urging device.

8. A sliding assistance apparatus according to claim 7, wherein said pair of strikers is arranged to be spaced apart from each other so that the sliders are located between the pair of strikers.

* * * * *